US007568887B1

(12) United States Patent
Liang

(10) Patent No.: US 7,568,887 B1
(45) Date of Patent: Aug. 4, 2009

(54) TURBINE BLADE WITH NEAR WALL SPIRAL FLOW SERPENTINE COOLING CIRCUIT

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 441 days.

(21) Appl. No.: 11/600,452

(22) Filed: Nov. 16, 2006

(51) Int. Cl.
*F01D 5/18* (2006.01)

(52) U.S. Cl. ..... 416/97 R

(58) Field of Classification Search ..... 415/115–116; 416/92, 96 R, 96 A, 97 R, 97 A
See application file for complete search history.

(56) References Cited

U.S. PATENT DOCUMENTS

| | | | | |
|---|---|---|---|---|
| 2,920,865 | A | 1/1960 | Lombard | |
| 3,533,712 | A | 10/1970 | Kercher | |
| 4,574,451 | A | 3/1986 | Smashey et al. | |
| 5,165,852 | A | 11/1992 | Lee et al. | |
| 5,215,431 | A | 6/1993 | Derrien | |
| 5,350,277 | A | 9/1994 | Jacala et al. | |
| 5,702,232 | A | 12/1997 | Moore | |
| 5,941,687 | A | 8/1999 | Tubbs | |
| 6,264,428 | B1 | 7/2001 | Dailey et al. | |
| 6,491,496 | B2 * | 12/2002 | Starkweather | 416/97 R |
| 6,565,312 | B1 | 5/2003 | Horn et al. | |
| 7,033,136 | B2 | 4/2006 | Botrel et al. | |
| 7,249,934 | B2 * | 7/2007 | Palmer et al. | 416/97 R |
| 2005/0025623 | A1 * | 2/2005 | Botrel et al. | 416/97 R |

* cited by examiner

*Primary Examiner*—Christopher Verdier
(74) *Attorney, Agent, or Firm*—John Ryznic

(57) ABSTRACT

A turbine blade for a gas turbine engine having a 5-pass serpentine flow cooling circuit with a first pressure side channel forming the first leg and being supplied with cooling air from an external source, a first down-pass channel on the suction side forming the second leg, a first collector cavity formed between the first and second leg to receive the cooling air from the second leg, a second collector cavity aft of the first collector cavity to receive cooling air from the first collector cavity through a core tie hole, a second pressure side cooling channel connected to the second collector cavity, a second suction side cooling channel to receive cooling air from the second pressure side channel, and a third up-pass channel along the trailing edge to receive cooling air from the second down-pass suction side channel.

18 Claims, 3 Drawing Sheets

TURBINE BLADE WITH NEAR WALL SPIRAL FLOW SERPENTINE COOLING CIRCUIT

CROSS-REFERENCE TO RELATED APPLICATIONS

This application is related to a U.S. patent application Ser. No. 11/503,546 filed on Aug. 11, 2006 and entitled TURBINE BLADE WITH A NEAR-WALL COOLING CIRCUIT, now U.S. Pat. No. 7,527,475 issued on May 5, 2009.

BACKGROUND OF THE INVENTION

1. Field of the Invention

The present invention relates generally to fluid reaction surfaces, and more specifically to turbine airfoils with a cooling circuit.

2. Description of the Related Art Including Information Disclosed under 37 CFR 1.97 and 1.98

Turbine airfoils, such as rotor blades and stator vanes, pass cooling air through complex cooling circuits within the airfoil to provide cooling from the extreme heat loads on the airfoil. A gas turbine engine passes a high temperature gas flow through the turbine to produce power. The engine efficiency can be increased by increasing the temperature of the gas flow entering the turbine. Therefore, an increase in the airfoil cooling can result in an increase in engine efficiency.

Prior art airfoil cooling of blades makes use of a single five-pass aft flowing serpentine cooling circuit 11-15 comprised of a forward section leading edge impingement cavity 17 and an aft flowing serpentine flow channels with airfoil trailing edge discharge cooling holes 20 as seen in FIG. 1. In the forward section of the blade leading edge impingement cooling, it is normally designed in conjunction with leading edge backside impingement plus showerhead and pressure side and suction side film discharge cooling holes. Cooling air is supplied from the first up-pass of the 5-pass serpentine flow circuit. The impingement cooling air is normally fed through a row of metering holes 16, impinged onto the backside of the airfoil leading edge surface to provide backside impingement cooking prior to discharging through the three showerhead holes 18 and pressure side and suction side gill holes 19.

In the prior art 5-pass aft flowing serpentine cooling circuit of FIG. 1, the internal cavities are constructed with internal ribs connecting the airfoil pressure and suction walls. In most of the cases, the internal cooling cavities are at low aspect ratios which is subject to high rotational affect on the cooling side heat transfer coefficient. In addition, the low aspect ratio cavity yields a very low internal cooling side convective area ratio to the airfoil hot gas external surface.

The object of the present invention is to provide for a blade with a cooling circuit that provides for a near wall spiral flow cooling arrangement which optimizes the airfoil mass average sectional metal temperature to improve airfoil creep capability for a blade cooling design.

Another object of the present invention is to maximize the airfoil cooling performance for a given amount of cooling air and minimize the Coriolis effects due to rotation on the airfoil internal cavities' heat transfer performance.

BRIEF SUMMARY OF THE INVENTION

A turbine blade with a near wall 5-pass spiral cooling flow circuit in which the mid-chord cooling cavity is oriented in the chordwise direction to form a high aspect ratio formation. Cooling air is fed into the spiral flow circuit on the first pressure side of the up-pass cooling channel. The cooling air then flows across the blade tip section and downward through the airfoil first suction side near wall cooling channel and is discharged into the first mid-chord collection cavity. Part of the cooling air from the first mid-chord collection cavity is then impinged onto the airfoil leading edge through a row of impingement holes, while the remaining portion of the cooling air is transferred to the second mid-chord collector cavity through a series of large core tie holes in-between both collector cavities. This cooling air then flows upward from the second pressure side near wall cooling channel and across the blade tip section and downward through the second near wall cooling channel and is discharged into the cooling compartment below the partition wall at the blade root section. This cooling air then flows upward from the cooling compartment through the airfoil trailing edge cooling channel for cooling the trailing edge region and distributes cooling for the airfoil trailing edge discharge cooling holes.

The cooling circuit of the present invention maximizes the airfoil rotational effects for the cooling channel internal heat transfer coefficient and achieves a better airfoil internal cooling performance for a given cooling supply pressure and flow level. Pin fins and trip strips can also be incorporated in these high aspect near wall cooling channels to further enhance internal cooling performance. Lower airfoil mass average sectional metal temperature and higher stress rupture life is also increased.

DETAILED DESCRIPTION OF THE INVENTION

Figure 2:
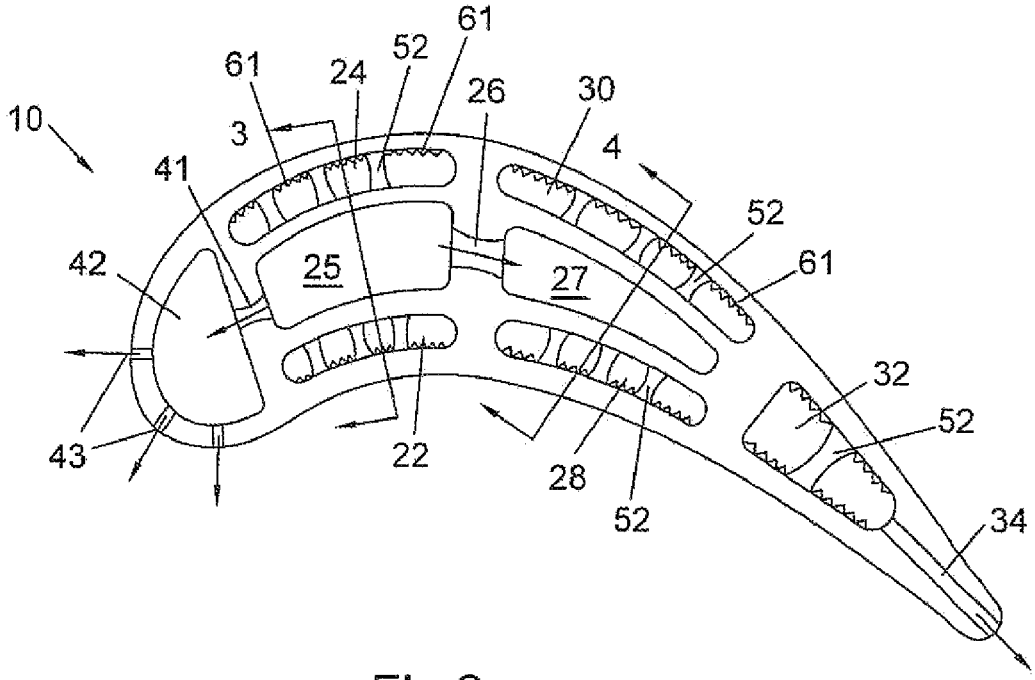
FIG. 2 shows a cross section view of the 5-pass serpentine flow cooling circuit of the present invention.

The present invention is a cooling circuit in a turbine blade used in a gas turbine engine under a high temperature operating environment. FIG. 2 shows the blade 20 with the 5-pass spiral cooling flow circuit. The cooling circuit is designed for use in a rotating turbine blade to take into account the rotational effects that occur on the cooling air flow through the blade circuit. However, the invention can also be applied to a stator vane that requires passage of a cooling air.

Figure 1:
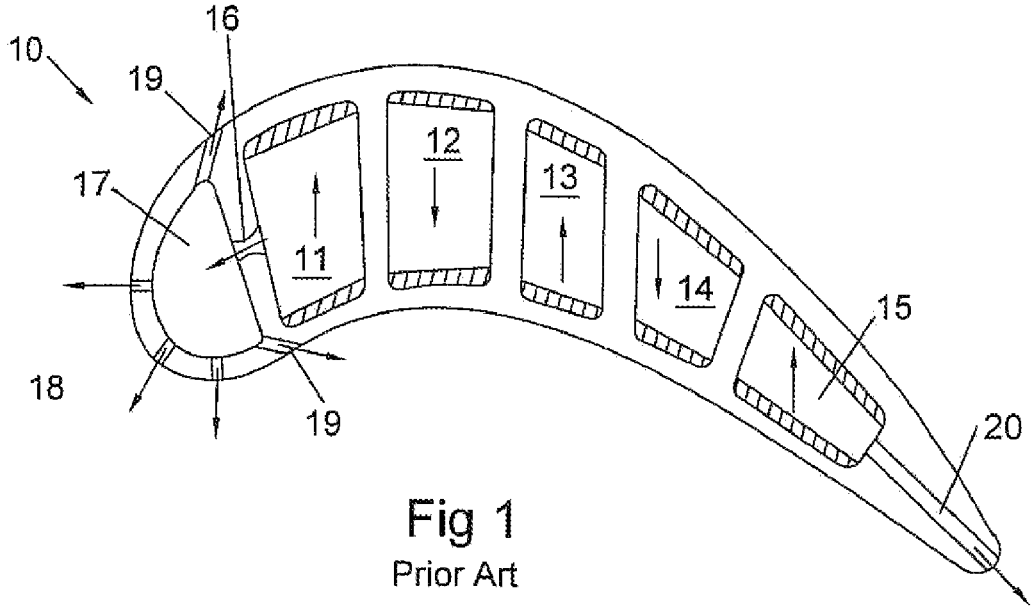
Fig 1 Prior Art
FIG. 1 shows a cross section view of a prior art 5-pass serpentine flow cooling circuit in a turbine blade.
Figure 3:
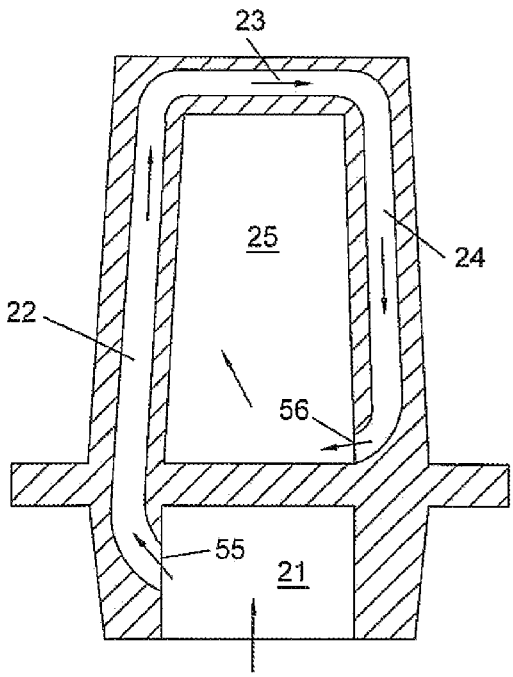
FIG. 3 shows a side view of a cross section of the forward section of the blade in FIG. 2.

The blade 20 include an internal cooling circuit that comprises a first up-pass cooling channel 22 on the pressure side of the blade, a first mid-chord collecting cavity 25, and a first down-pass cooling channel 24 on the suction side of the blade. These channels 22 and 24 and cavity 25 extend along the blade chordwise direction with substantially the same lengths as seen in FIG. 1. As seen in FIG. 3, the first up-pass cooling channel 22 is connected to the first down-pass cooling channel 24 through a first blade tip cooling channel 23. Pin fins 52 and trip strips (not shown) can be included within the channels to increase the heat transfer coefficient from the channel wall to the cooling air. An air supply cavity or passage 21 (see FIG. 3) is located below the first mid-chord collecting cavity 25 and is connected to the first up-pass cooling channel 22 through a first pressure side cooling channel inlet hole 55.

A partition wall separates the air supply cavity 21 from the first mid-chord collecting cavity 25. The first down-pass cooling channel 24 is connected to the first mid-chord collecting cavity 25 through a first suction side cooling channel outlet hole 56 as seen in FIG. 3. Cooling air is supplied to the blade cooling circuit from an external source into the cooling air supply cavity or passage 21.

Figure 4:
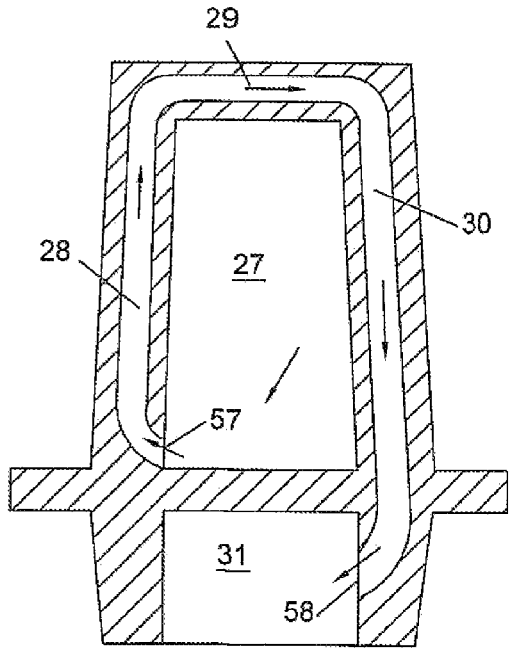
FIG. 4 shows a side view of a cross section of the aft section of the blade in FIG. 2.

The blade also includes a second pressure side up-pass cooling channel 28 on the pressure side of the blade, a second down-pass cooling channel 30 on the suction side of the blade, and a second mid-chord collecting cavity 27 positioned between the two channels 28 and 30. The two channels 28 and 30 and the cavity 27 have substantially the same length along the blade chordwise direction as seen in FIG. 2. As seen in FIG. 4, the second up-pass cooling channel 28 is connected to the second down-pass cooling channel 30 through a second blade tip cooling channel 29. Pin fins 52 and trip strips (not shown) can be included within the channels to increase the heat transfer coefficient from the channel wall to the cooling air. A root section compartment 31 (see FIG. 4) is located below the second mid-chord collecting cavity 27 and is connected to the second up-pass cooling channel 28 through a second pressure side cooling passage outlet hole 57. A partition wall separates the root section or air return cavity 31 from the second mid-chord collecting cavity 27. The second down-pass cooling channel 30 is connected to the root section compartment 31 through a second suction side cooling passage outlet hole 58 as seen in FIG. 4.

Figure 5:
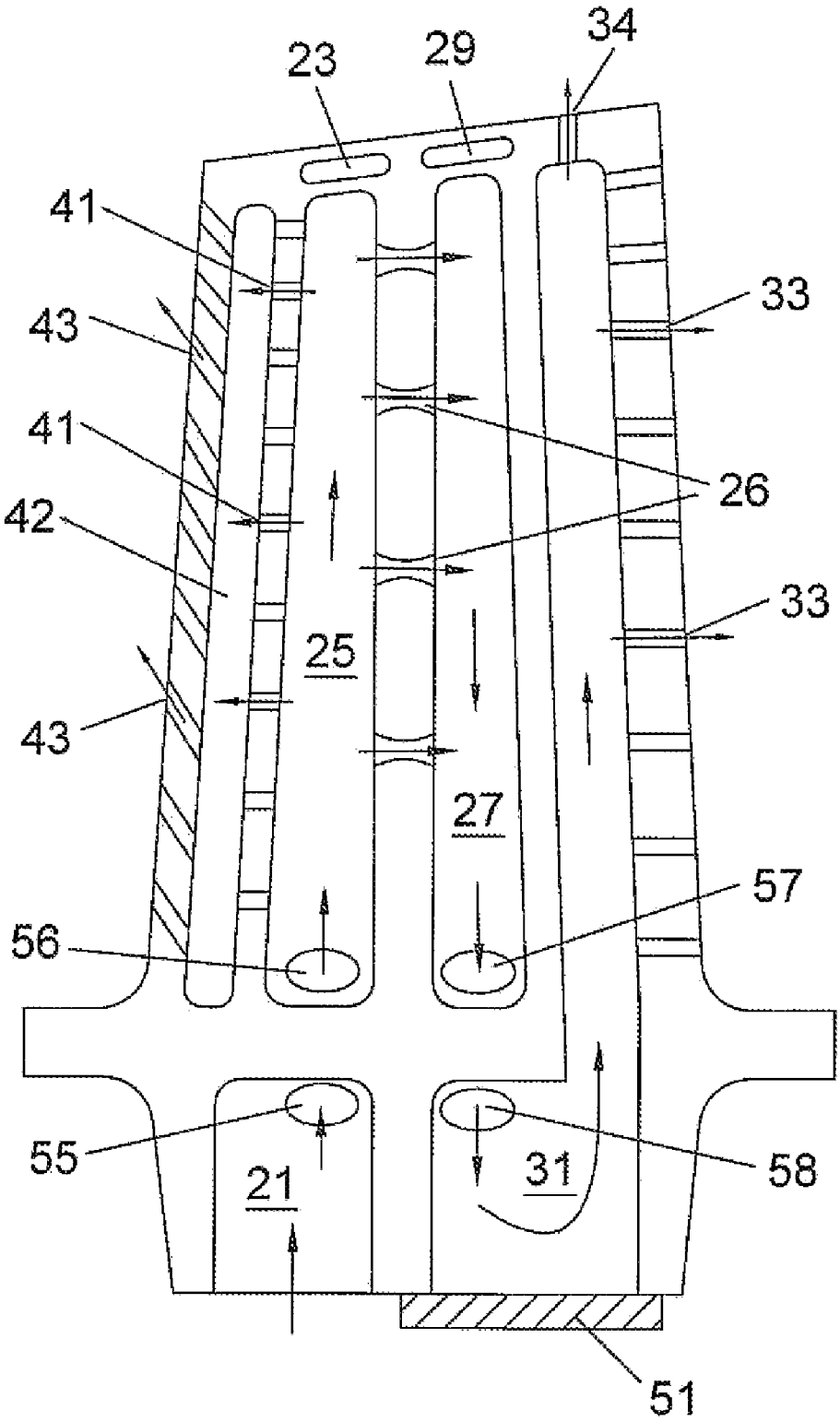
FIG. 5 shows cross section side view of the cooling circuit of the present invention along the blade camber line.

As seen in FIGS. 2 and 5, a leading edge cooling cavity 42 is connected to the first mid-chord collecting cavity 25 through at least one metering and impingement hole 41 and a showerhead cooling arrangement with film cooling holes 43 are connected to the leading edge cavity 42 to provide film cooling for the leading edge of the blade. The first mid-chord collecting cavity 25 is connected to the second mid-chord collecting cavity through at least one core tie hole formed in the rib that separates the two cavities 25 and 27.

A third up-pass cooling channel 32 is located in the trailing edge region of the blade and is positioned to be between both the pressure side wall and the suction side wall to provide near wall cooling to both walls. A plurality of exit holes 34 extending along the trailing edge of the blade are connected to the third up-pass channel 32. As seen in FIG. 5, a blade tip cooling hole 34 also is connected to the third-up pass channel 32. Pin fins 52 and trip strips (not shown) can be included within the third up-pass channel 32 to increase the heat transfer coefficient from the channel wall to the cooling air. The third up-pass cooling channel 32 in the trailing edge region is connected to the root section compartment 31 as seen in FIG. 5. A cover plate 51 is used to close an opening formed in the root section compartment 31 to force the cooling air exiting the hole 58 into the third up-pass cooling channel 32 along the trailing edge.

Operation of the blade 20 of the present invention is now described. Cooling air is fed into the spiral flow circuit on the first pressure side of the first up-pass cooling channel 22 through the cooling supply cavity 21. The cooling air then flows across the first blade tip channel 23 to cool the blade tip section and downward through the airfoil first suction side near wall cooling channel 24 and discharged into the first mid-chord collection cavity 25. Part of the cooling air from the first mid-chord collection cavity 25 is then impinged onto the airfoil leading edge through a row of impingement holes 41, while the remaining portion of the cooling air is transferred to the second mid-chord collector cavity 27 through a series of large core tie holes 26 in-between both collector cavities 25 and 27. This cooling air then flows upward from the second pressure side near wall cooling channel 28 and across the blade tip section through the second blade tip channel 29 and downward through the second near wall cooling channel 30 and discharged into the root section compartment 31 located below the partition wall at the blade root section. This cooling air then flows upward from the root section cooling compartment 31 and through the airfoil trailing edge cooling channel 32 for cooling the trailing edge region and distributes cooling for the airfoil trailing edge discharge cooling holes 33 and the blade tip cooling hole 34. Pin fins 52 and trip strips 61 are positioned along the hot walls of the channels in order to increase the heat transfer effect from the channels to the cooling air.

The pin fins 52, the metering holes 41 and the core tie holes 26 can be sized to vary the pressure and the amount of cooling air flowing through the serpentine flow 5-pass cooling circuit. Film cooling holes can also be used on the suction side wall and the pressure side wall that connect one or more of the suction side or pressure side channels to the wall for film cooling. Also, the leading edge cooling cavity 17 can be formed of separate compartment extending along the spanwise direction of the blade, with each compartment connected to the first mid-chord collecting cavity 25 through at least one metering and impingement hole 41.

I claim the following:

1. A turbine airfoil for use in a high temperature turbine, the airfoil comprising:

an airfoil wall forming a pressure side and a suction side, and a leading edge and a trailing edge;

a five pass serpentine flow cooling circuit within the airfoil, the five pass serpentine circuit comprising a first up-pass leg adjacent to the pressure side of the airfoil, a second down-pass leg adjacent to the suction side of the airfoil, a third up-pass leg adjacent to the pressure side of the airfoil, a fourth down-pass leg adjacent to the suction side of the airfoil, and a fifth up-pass leg positioned along the trailing edge of the airfoil;

a collector cavity in fluid communication with the serpentine flow circuit and fluidly positioned between the second leg and the third leg;

the collector cavity is positioned between the first four legs of the serpentine flow circuit; and, the collector cavity includes a first collector cavity positioned between the first and second legs, a second collector cavity positioned between the third and fourth legs, the first collector cavity in fluid communication with the second leg, the second collector cavity in fluid communication with the third leg, and a core tie hole providing a fluid communication between the two cavities.

2. The turbine airfoil of claim 1, and further comprising:

a first blade tip channel providing for a fluid communication between the first and second legs and providing near wall cooling for the blade tip.

3. The turbine airfoil of claim 2, and further comprising:

a second blade tip channel providing for a fluid communication between the third and fourth legs and providing near wall cooling for the blade tip.

4. The turbine airfoil of claim 1, and further comprising:

a root section compartment providing for a fluid communication between the fourth and fifth legs.

5. The turbine airfoil of claim 1, and further comprising:

a plurality of exit holes extending along the trailing edge of the airfoil and in fluid communication with the fifth leg.

6. The turbine airfoil of claim 1, and further comprising:

a leading edge cooling air supply cavity in fluid communication with the first leg and a showerhead film cooling hole arrangement.

7. The turbine airfoil of claim 1, and further comprising:

the first leg, the second leg and the first collector cavity have substantially the same chordwise length; and, the third leg, the fourth leg and the second collector cavity have substantially the same chordwise length.

8. The turbine airfoil of claim 1, and further comprising:

the legs of the five-pass serpentine circuit include pin fins extending across the legs to increase a heat transfer coefficient.

9. The turbine airfoil of claim 1, and further comprising:

the legs of the five-pass serpentine circuit include trip strips extending along the hot wall portion of the legs to increase a heat transfer coefficient.

10. The turbine airfoil of claim 1, and further comprising:

a plurality of core tie holes providing a fluid communication between the two cavities.

11. The turbine airfoil of claim 4, and further comprising:

the airfoil is for a blade that includes a root section, a platform section and the airfoil; and, the root section compartment is formed in the root section of the blade and enclosed by a closure plate.

12. The turbine airfoil of claim 1, and further comprising:

the airfoil is for a blade that includes a root section, a platform section and the airfoil; and the legs of the five pass serpentine flow circuit each extend from the root of the blade to the blade tip region and along the airfoil wall to provide for near wall cooling of the airfoil.

13. The turbine airfoil of claim 1, and further comprising:

a first blade tip channel providing for a fluid communication between the first and second legs and providing near wall cooling for the blade tip; and, a second blade tip channel providing for a fluid communication between the third and fourth legs and providing near wall cooling for the blade tip.

14. The turbine airfoil of claim 1, and further comprising:

a plurality of exit holes extending along the trailing edge of the airfoil and in fluid communication with the fifth leg.

15. The turbine airfoil of claim 14, and further comprising:

a leading edge cooling air supply cavity in fluid communication with the first leg and a showerhead film cooling hole arrangement.

16. An air cooled turbine rotor blade comprising:

a leading edge and a trailing edge;

a pressure side wall and a suction side wall extending between the leading edge and the trailing edge;

a cooling air supply cavity formed within a root section of the blade;

a cooling air collection cavity formed between the pressure side wall and the suction side wall and extending from near to a platform of the blade to near the blade tip;

a first radial extending cooling channel formed within the pressure side wall and extending from the cooling air supply cavity to a blade tip cooling channel;

the blade tip cooling channel extending from the pressure side wall to the suction side wall;

a second extending radial cooling channel formed within the suction side wall and extending from the cooling air supply cavity to the blade tip cooling channel;

the second radial extending cooling channel connected to the cooling air collecting cavity; and, the first radial extending cooling channel and the blade tip cooling channel and the second radial extending cooling channel forming a closed cooling passage between the cooling air supply channel and the collecting cavity.

17. The air cooled turbine rotor blade of claim 16, and further comprising:

the first radial extending cooling channel, the blade tip cooling channel, the second radial extending cooling channel and the cooling air supply channel and the collecting cavity all have about the same chordwise length.

18. The air cooled turbine rotor blade of claim 17, and further comprising:

the first radial extending cooling channel and the second radial extending cooling channel include a plurality of pin fins extending across the channels.

* * * * *